US009428950B2

(12) United States Patent
Braungart

(10) Patent No.: US 9,428,950 B2
(45) Date of Patent: Aug. 30, 2016

(54) ARRANGEMENT FOR MOVING A MOVABLE FURNITURE PART

(71) Applicant: Julius Blum GmbH, Hoechst (AT)

(72) Inventor: Hansjoerg Braungart, Berghuelen (DE)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/534,621

(22) Filed: Nov. 6, 2014

(65) Prior Publication Data

US 2015/0084492 A1 Mar. 26, 2015

Related U.S. Application Data

(63) Continuation of application No. PCT/AT2013/000043, filed on Mar. 8, 2013.

(30) Foreign Application Priority Data

May 25, 2012 (AT) ..... 617/2012

(51) Int. Cl.
*A47B 95/00* (2006.01)
*E05D 15/26* (2006.01)
(Continued)

(52) U.S. Cl.
CPC ..... *E05D 15/262* (2013.01); *E05B 53/005* (2013.01); *E05D 15/264* (2013.01);
(Continued)

(58) Field of Classification Search
CPC ..... E05Y 2201/426; E05Y 2900/20; E05Y 2201/638; E05Y 2201/654; E05D 15/262; E05D 15/264; E05F 1/105; E05B 53/005
USPC ..... 312/297, 319.2, 327, 328; 49/276, 279, 49/280, 301
See application file for complete search history.

(56) References Cited

U.S. PATENT DOCUMENTS 3,378,323 A * 4/1968 Goldberg ..... B65F 1/1426 211/83
3,984,162 A * 10/1976 Zozzaro ..... A47B 31/00 312/100

(Continued)

FOREIGN PATENT DOCUMENTS

| | | |
|---|---|---|
| AT | 13 571 | 3/2014 |
| CN | 101535586 | 9/2009 |

(Continued)

OTHER PUBLICATIONS

International Search Report (ISR) issued Jul. 4, 2013 in International (PCT) Application No. PCT/AT2013/000043.

(Continued)

*Primary Examiner* — Janet M Wilkens
(74) *Attorney, Agent, or Firm* — Wenderoth, Lind & Ponack, L.L.P.

(57) ABSTRACT

An arrangement for moving a movable furniture part, in particular a furniture part which is mounted pivotably about an axis, includes at least one ejection device for ejecting the movable furniture part from a closed position into an open position, and the at least one ejection device includes at least one force accumulator. The arrangement further includes a loading device for loading the at least one force accumulator by an opening or closing movement of the movable furniture part. At least one Bowden cable for transmitting force during the loading of the at least one force accumulator is arranged between the at least one ejection device and the loading device.

20 Claims, 7 Drawing Sheets

(51) Int. Cl.

| | |
|---|---|
| ***E05B 53/00*** | (2006.01) |
| ***E05F 1/10*** | (2006.01) |
| ***E05F 1/12*** | (2006.01) |
| *E05C 19/02* | (2006.01) |

(52) U.S. Cl.

CPC ..... *E05F 1/105* (2013.01); *E05F 1/1261* (2013.01); *E05C 19/022* (2013.01); *E05Y 2201/426* (2013.01); *E05Y 2201/638* (2013.01); *E05Y 2201/654* (2013.01); *E05Y 2900/20* (2013.01)

(56) References Cited

U.S. PATENT DOCUMENTS

| | | | | |
|---|---|---|---|---|
| 4,907,715 | A * | 3/1990 | Bloomer | 220/263 |
| 5,244,269 | A * | 9/1993 | Harriehausen et al. | 312/247 |
| 5,324,105 | A * | 6/1994 | Christensen | A47F 7/0057 206/303 |
| 8,109,583 | B2 * | 2/2012 | Bruestle | 312/319.2 |
| 2004/0205935 | A1 * | 10/2004 | Lautenschlaeger et al. | 16/374 |
| 2004/0239213 | A1 * | 12/2004 | Hirtsiefer | 312/109 |
| 2005/0179280 | A1 * | 8/2005 | Ritter | E05F 15/63 296/76 |
| 2007/0124893 | A1 * | 6/2007 | Brustle | 16/296 |
| 2010/0066220 | A1 * | 3/2010 | Grimm | 312/237 |
| 2011/0131884 | A1 | 6/2011 | Herper et al. | |
| 2011/0138960 | A1 * | 6/2011 | Omann et al. | 74/490.07 |
| 2011/0266937 | A1 * | 11/2011 | Roberts et al. | 312/319.1 |

FOREIGN PATENT DOCUMENTS

| | | | |
|---|---|---|---|
| CN | 101883907 | | 11/2010 |
| CN | 101952530 | | 1/2011 |
| CN | 102046044 | | 5/2011 |
| DE | 4335151 | * | 4/1995 |
| DE | 102008016361 | * | 4/2009 |
| DE | 20 2010 008 134 | | 10/2010 |
| WO | 0120130 | * | 3/2001 |
| WO | 2008/022673 | | 2/2008 |
| WO | 2008141348 | * | 11/2008 |
| WO | 2012/000656 | | 1/2012 |

OTHER PUBLICATIONS

Austrian Patent Office Search Report (ASR) issued Jan. 28, 2013 in Austrian Patent Application No. A 617/2012.

Office Action and Search Report issued Oct. 12, 2015 in corresponding Chinese Application No. 201380026983.X with English translation.

* cited by examiner

ARRANGEMENT FOR MOVING A MOVABLE FURNITURE PART

BACKGROUND OF THE INVENTION

The invention concerns an arrangement for moving a moveable furniture part, in particular a furniture part mounted pivotably about an axis. The arrangement includes at least one ejection device for ejecting the moveable furniture part from a closed position into an open position, and the at least one ejection device includes at least one force storage element. A loading device loads the at least one force storage element by an opening or closing movement of the moveable furniture part.

Such arrangements are known from application number A 322/2012 to the present applicant which is of an earlier priority date but which has not yet been published. They have relatively complicated and expensive transmission mechanisms disposed between the at least one ejection device and the loading device for the transmission of force upon loading of the at least one force storage element. Thus, for example, direction-changing devices or intermediate panels are required, which take up a very great deal of space. That is also disadvantageous from esthetic points of view.

Further specifications defining the general state of the art are represented by WO 2012/000656, WO 2008/022673 and DE 20 2010 008 134.

SUMMARY OF THE INVENTION

The object of the present invention is to avoid the above-described disadvantages and to provide an improved arrangement for moving a moveable furniture part.

To attain that object, the arrangement provides that at least one Bowden cable for transmitting force upon loading of the at least one force storage element is arranged between the at least one ejection device and the loading device.

The term "Bowden cable" is an established term defined for example by DIN 71986. A man skilled in the art interprets that as meaning a moveable machine element for the transmission of a mechanical movement or a tensile force. Essentially, a Bowden cable comprises a so-called Bowden cable core (for example a steel wire or wire cable) surrounded by a casing which is flexible but which is compression-resistant in the tensile direction. The casing acts as a mechanical guide and as a support for the tensile forces to be transmitted so that the Bowden cable can transmit forces even by way of bends.

What is advantageous in regard to the use of a Bowden cable in connection with the subject of the present invention is that it takes up relatively little space and can be flexibly laid. It is also possible for it to be "concealed", for example, in a groove or the like in relation to the exterior.

In an advantageous embodiment of the invention, the loading device includes at least one adjusting body and at least one adjusting contour. The at least one adjusting body runs against the at least one adjusting contour at least during a part of the opening or closing movement. Different kinematic conditions can be achieved by the interplay of the at least one adjusting body and the at least one adjusting contour. In particular, it is also possible to implement a neutral region in which the at least one adjusting body and the at least one adjusting contour move relative to each other in such a way that the at least one force storage element is not loaded. A further great advantage arising out of the interplay of the at least one adjusting body and the at least one adjusting contour is the fact that the transitions between loading and non-loading of the force storage element can be of a very smooth and gentle nature.

In addition, the at least one ejection device includes at least one moveable—preferably linearly displaceable—ejection element which can be acted upon by the at least one force storage element. In that respect, it is advantageous if the at least one ejection device includes at least one locking device for releasably locking the at least one ejection element against action thereon by the at least one force storage element. The locking device can be embodied in that case for example by means of a tilting lever. An alternative embodiment of the locking device not excluded from the concept of the invention can, for example, also be based on a locking contour which has a cardioid configuration.

Protection is also claimed for an article of furniture comprising a furniture carcass, at least one furniture part mounted moveably in or on the furniture carcass, and at least one arrangement according to the invention for moving the at least one furniture part. The at least one furniture part can be either a furniture part which performs a rotational movement (that is the case for example with a furniture door or a furniture flap), or a furniture part which is moveable with a translatory movement (for example a drawer).

The use of the arrangement according to the invention presents itself in particular in relation to upper cupboards which have an external support structure and an inner carcass which can be moved up and down in relation to that support structure. Here, the at least one Bowden cable, when the inner carcass is moved up, can be disposed substantially between the inner carcass and the furniture carcass so that it is not visible outwardly.

BRIEF DESCRIPTION OF THE DRAWINGS

Further advantageous embodiments of the invention are defined in the appendant claims and are described more fully together with further details and advantages of the invention in the context of the specific description hereinafter with reference to the Figures, in which:

DETAILED DESCRIPTION OF THE INVENTION

Figure 1:
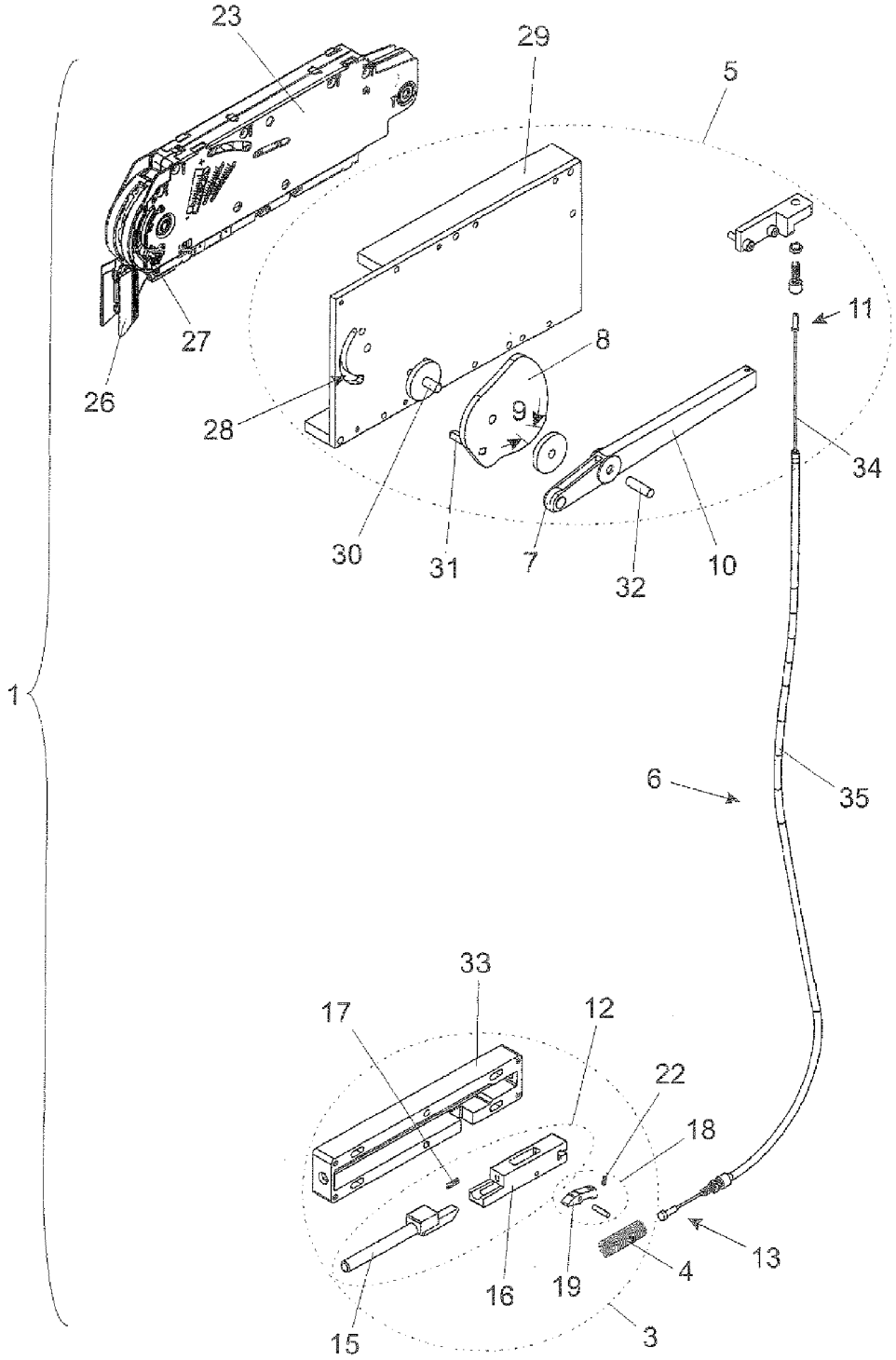
FIG. 1 is a diagrammatic exploded view of an embodiment of the arrangement according to the invention.

With reference to the exploded view shown in FIG. 1 it can be seen that the ejection device 3 of the arrangement 1 includes an ejection element 12 which is moveable, more precisely linearly displaceable, and which can be acted upon by a force storage element 4 in the form of a spring. The ejection element 12 has two parts 15 and 16 which are moveable relative to each other over a limited distance 14 (see FIGS. 7*a* through 7*e*), and a compression spring 17 is arranged between the two parts 15 and 16. The ejection element 12 is arranged linearly displaceably in a parallel-epipedic housing 33. A further substantial component of the ejection device 3 is a locking device 18 for releasably locking the ejection element 12 in relation to being acted upon by the force storage element 4, and the locking device 18 is releasable by over-pressing in opposition to the ejection direction. The core element of the locking device 18 is a tilting lever 19. On one arm, the tilting lever 19 has a latching projection 20, and on the other arm, it has an inclined surface 21 (see FIGS. 7*a* through 7*e*) and it is acted upon by a compression spring 22. The precise mode of operation of the ejection device 3 will be described in greater detail with reference to FIGS. 7*a* through 7*e*.

Figure 6:
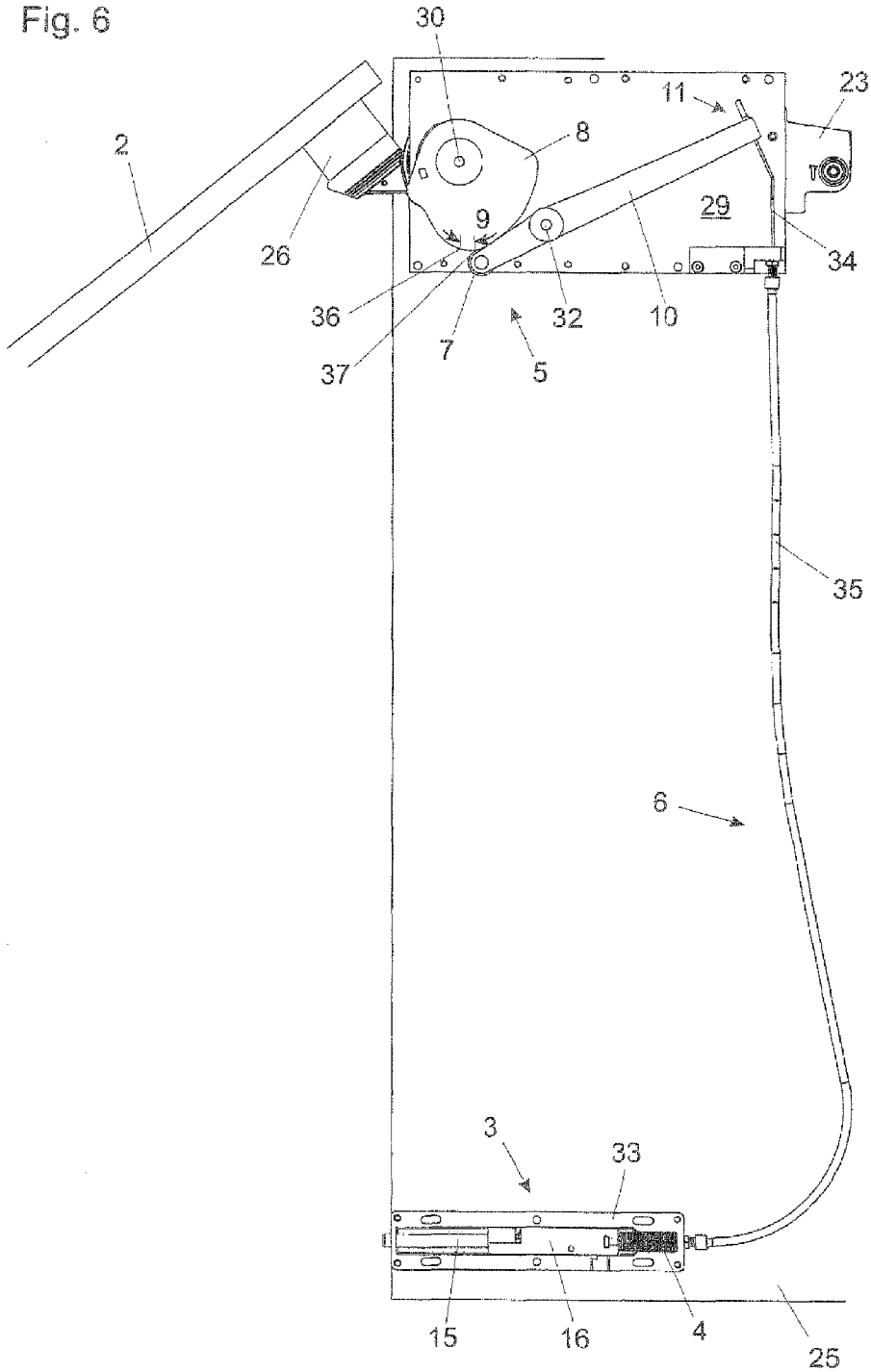

Substantial components of the loading device 5 for loading the force storage element 4 of the ejection device 3 are a base plate 29 on which an adjusting contour 8 and a double-armed lever 10 are rotatably mounted. The corresponding axes of rotation are denoted by references 30 and 32, respectively. Provided on a first arm of the lever 10 is an adjusting body 7 in the form of a pressure roller, the adjusting body 7 running against the adjusting contour 8. A characteristic feature of the adjusting contour 8 is a neutral portion 9 in which the adjusting body 7 and the adjusting contour 8 move relative to each other in such a way that the force storage element 4 of the ejection device 3 is not loaded (see also FIG. 6).

A Bowden cable 6 is arranged between the ejection device 3 and the loading device 5 for the transmission of force upon loading of the force storage element 4 of the ejection device 3. The Bowden cable 6 includes a Bowden cable core 34 guided moveably in a flexible outer casing 35. A first end 11 of the Bowden cable core 34 of the Bowden cable is operatively connected to the second arm of the double-armed lever 10 that does not have the adjusting body 7. The second end 13 of the Bowden cable core of the Bowden cable is connected to the rear (second) part 16 of the ejection element of the ejection device 3.

And finally, the arrangement 1 includes an adjusting drive 23 for holding a furniture flap 2 (see for example FIG. 2), in which that adjusting drive 23 is connected on the one hand to the furniture flap by an adjusting arm 26 and on the other hand is operatively connected to the loading device 5. For that purpose, the base plate 29 is mounted laterally to the adjusting drive 23. A motional coupling between the adjusting arm 26 of the adjusting drive 23—and thus the furniture flap which is connected to the adjusting arm 26—and the adjusting contour 8 of the loading device 5 is afforded by a pin 31. The pin 31 is guided in guide tracks 27 and 28.

The mode of operation of the preferred embodiment of the arrangement according to the invention will now be described in greater detail with reference to the further Figures.

Figure 2:
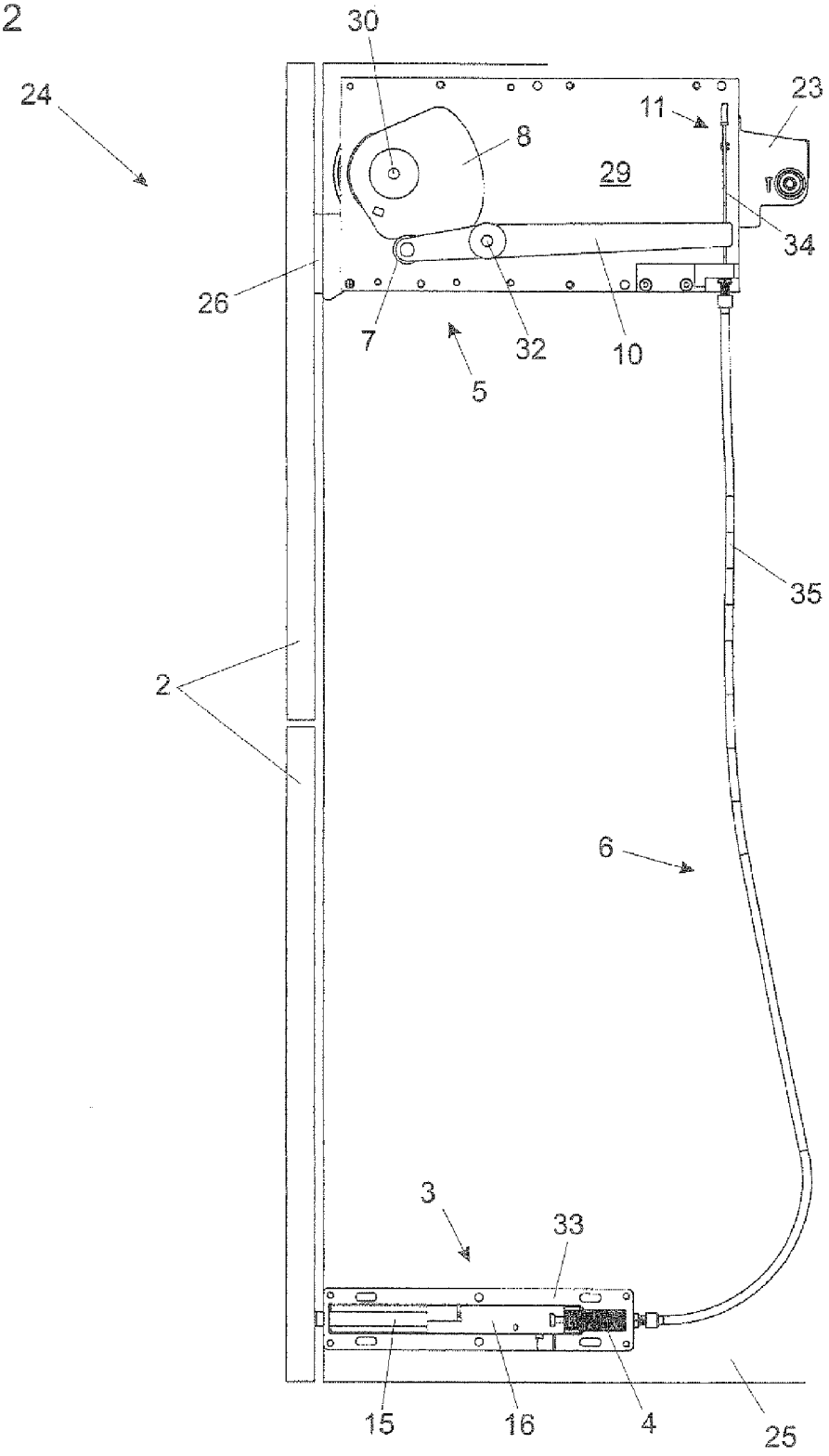
FIGS. 2-6 are a succession of diagrammatic side views of the embodiment of the arrangement according to the invention for illustration of the ejection process of a furniture flap and the loading process subsequently thereto for loading the force storage means of the ejection device.

FIG. 2 shows a side view of a diagrammatically illustrated article of furniture 24, the article of furniture 24 comprising a furniture carcass 25 and a furniture part 2 mounted moveably thereto in the form of a furniture flap 2 mounted pivotably about a horizontal axis. The furniture flap 2 is made up of two mutually superposed flap portions connected together by way of hinges (not shown). The upper flap portion is pivotably connected on the one hand by hinges (not shown) to the furniture carcass and on the other hand is connected to the adjusting arm 26 of the adjusting drive 23. In the closed condition of the furniture flap 2, the lower flap portion bears loosely against a contact surface of the front (first) part 15 of the ejection element 12, wherein in that condition the ejection element 12 is releasably locked against actuation by the force storage element 4 by the above-described locking device.

Figure 3:
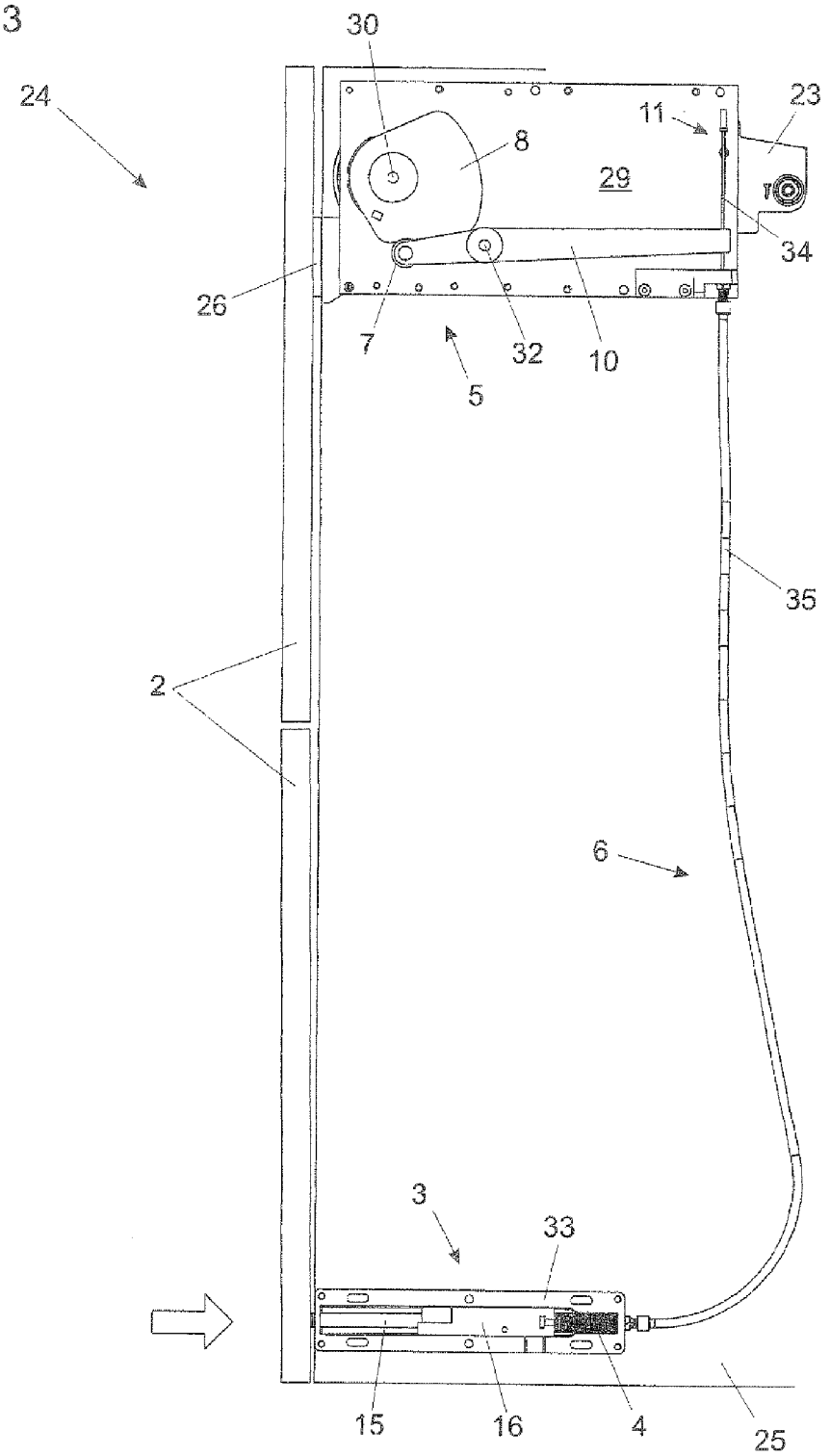

A further great advantage of the present invention is that, by means of the arrangement according to the invention, it is possible for the moveable furniture part 2 to be provided without a handle. For opening purposes, a user merely has to apply a light pressure to the front of the furniture part 2, in this case to the lower flap portion of the folding flap, whereby the ejection element of the ejection device is unlocked and ejects the furniture part 2 to such an extent that the user can comfortably engage behind the furniture flap 2 for further opening thereof. Initiation of that ejection movement is shown in FIG. 3. Due to the light pressure exerted on the lower flap portion (indicated by means of an arrow), the ejection element 12 is over-pressed, that is to say moved in the direction opposite to the direction in which is acted upon by the force storage element 4. As a result, the tilting lever 19 of the locking device is unlocked (see FIG. 7*b*).

As a further consequence (see FIG. 4) the energy stored in the force storage element 4 is liberated and, as a result, the front part 15 of the ejection element 12 of the ejection device 3 is ejected. As the front part 15 of the ejection element bears against the folding flap, it moves the flap 2 from the closed position into an open position.

As already stated in the course of the description of FIG. 1, the second end of the Bowden cable core 34 of the Bowden cable 6 is connected to the rear part 16 of the ejection element. As a result, in the ejection movement, the Bowden cable core 34 is drawn a distance through the flexible outer casing 35 by the energy of the force storage element 4. That will be seen, for example, from the fact that the first end 11 of the Bowden cable core 34 of the Bowden cable has moved downwardly.

Figure 5:
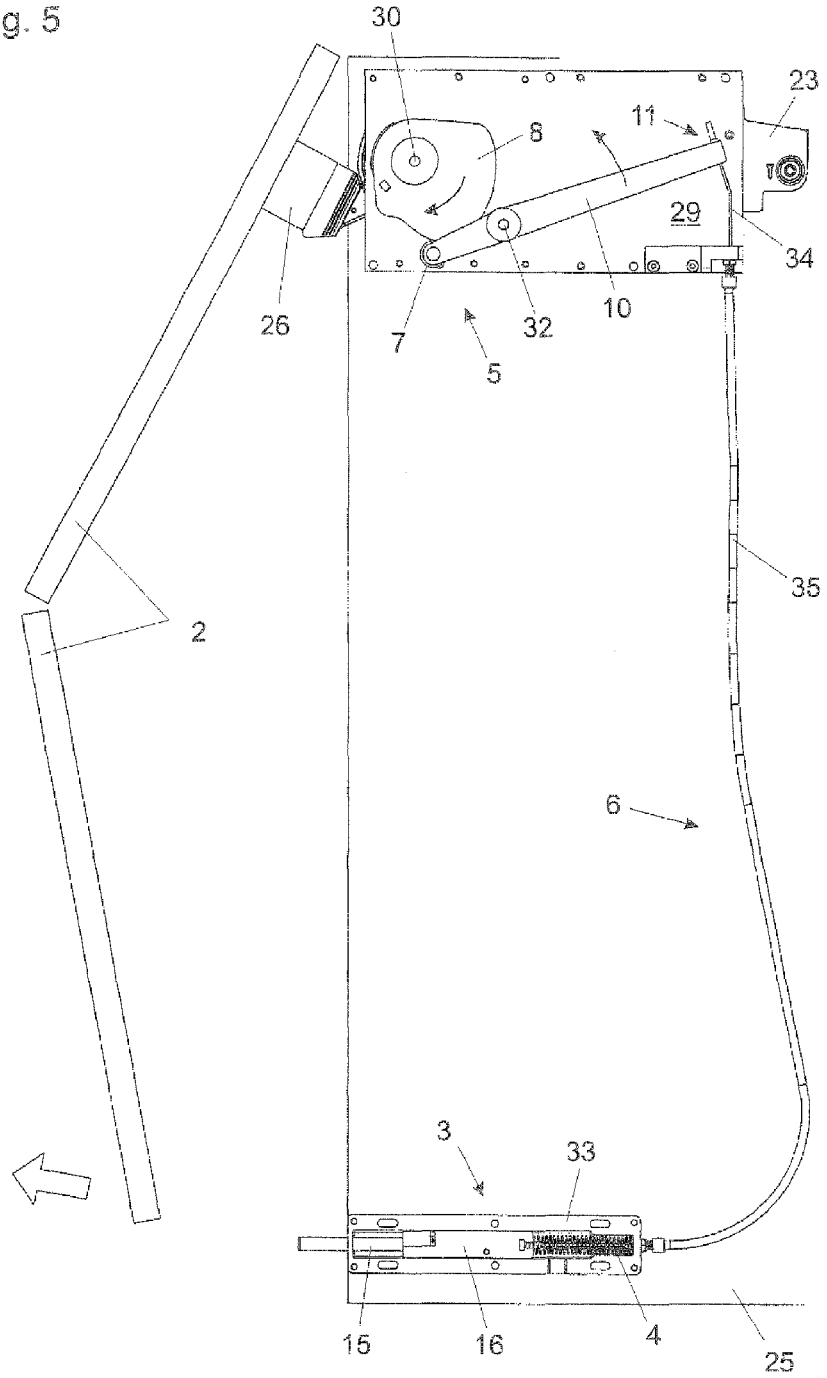

In the course of the ejection movement, the folding flap 2 was moved away from the furniture carcass 25 to such an extent (typically 5-10 cm) that the user can now engage behind the folding flap without any problem and can further manually open the same (see FIG. 5). The adjusting drive 23 connected to the flap 2 serves in that case for the purpose of compensating for the force due to the weight of the furniture flap 2 in any position. This means that the folding flap 2 can be held in any position without it falling closed again.

Figure 4:
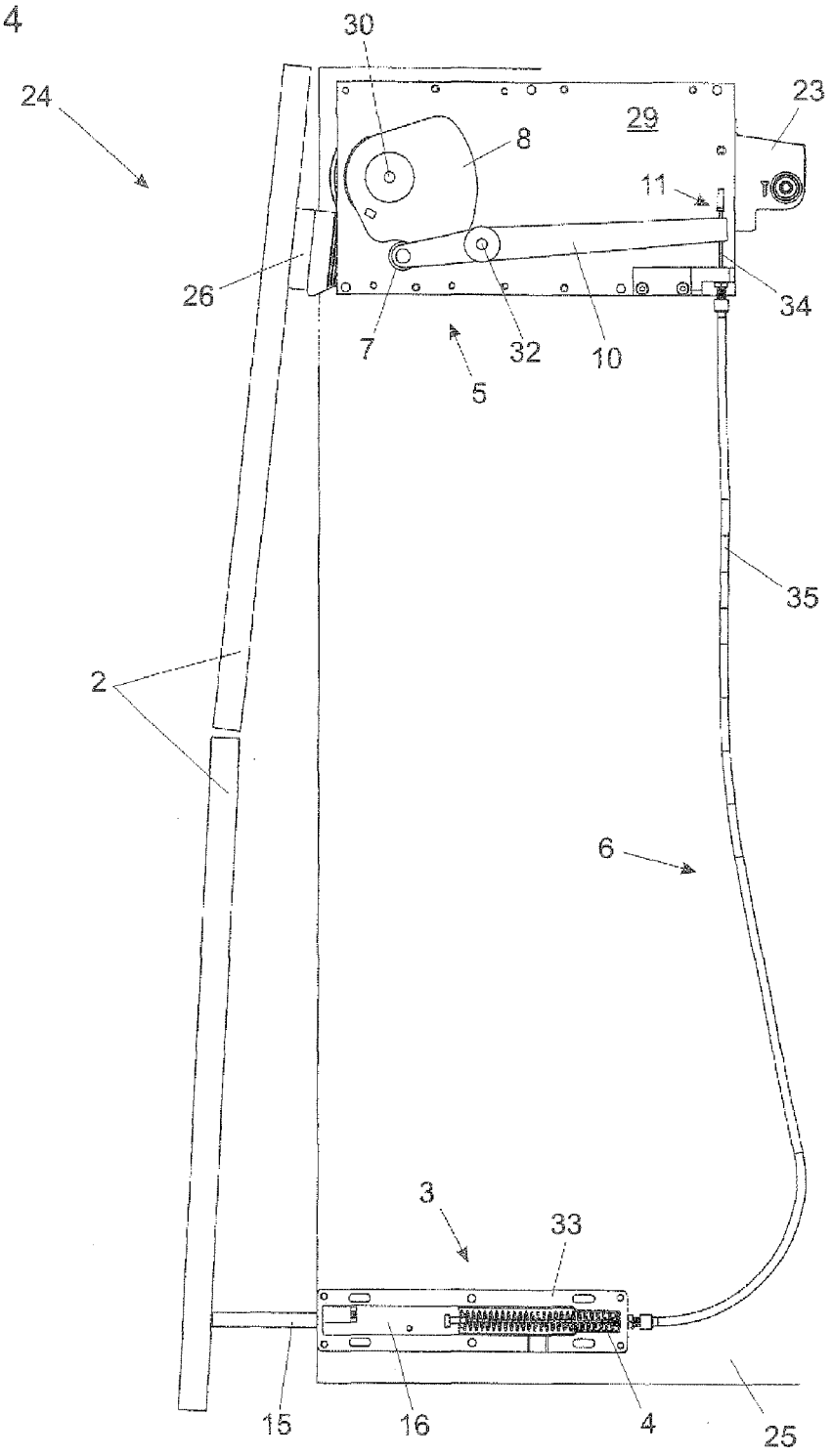

It will be apparent from a comparison of FIG. 4 with FIG. 5 that the adjusting contour 8 rotates in the clockwise direction during the pivotal movement of the folding flap 2 in the opening direction. Due to its specific shape, the adjusting contour 8 forces the double-armed lever 10 to perform a deflecting rotary movement in the opposite direction of rotation (counter clockwise). As a result, as a further consequence, the first end 11 of the Bowden cable core 34 of the Bowden cable 6 is pulled upwardly. In addition, attention is to be directed to the fact that the two arms of the double-armed lever 10 are of differing lengths, thereby giving an advantageous force ratio.

Because a pulling force is applied to the first end 11 of the Bowden cable core 34 of the Bowden cable, the second end 13 of the Bowden cable core 34 of the Bowden cable and thus the ejection element 15, 16 of the ejection device 3 moves back in the direction of the original position (see FIG. 2). At the same time the force storage element 4 which is fixedly held between the rear part 16 of the ejection element and the housing 33 is loaded. Considered overall, therefore, a part of the force applied by the user for opening the folding flap 2 is used for loading the force storage element 4 of the ejection device 3. In that case, transmission of that part of the force is effected by the Bowden cable 6. It is also clear from the above explanation of the Bowden cable 6 that the force transmitted by the Bowden cable to the force storage element 4 is performed without the Bowden cable 6 transmitting any force to the moveable furniture part 2.

The loading process for the force storage element 4 takes place until the ejection element has again reached its locking position. At that moment, the pressure roller 7 is at the location 36 on the control contour 8 (see FIG. 6). At the same time, the folding flap 2 assumes a central position between the closed position (see FIG. 2) and the completely opened position (see FIG. 6). In the further opening movement of the folding flap 2 the force storage element 4 is not further loaded. That is achieved by the arrangement on the control contour 8 of a neutral portion 9 which is adapted so that the spacing of the peripheral surface relative to the point of rotation 30 does not further increase between the points 36 and 37. Upon a further rotary movement of the control contour 8, therefore, the position of the double-armed lever 10 does not change.

When the folding flap 2 is closed, the control contour 8 and the lever 10 perform the oppositely directed movements—in comparison with opening of the flap. The first end 11 of the Bowden cable core 34 of the Bowden cable 6 however remains in its position as the ejection element is locked.

Figure 7A:
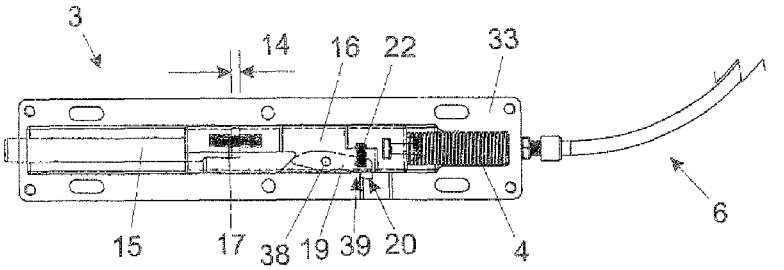
FIGS. 7*a*-7*e* are a succession of diagrammatic cross-sectional views of the ejection device to illustrate their mode of operation.
Figure 7B:
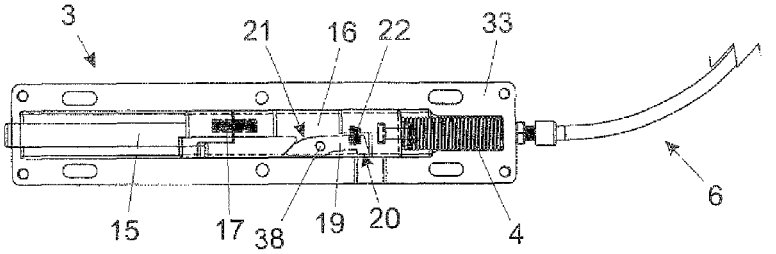
Figure 7C:
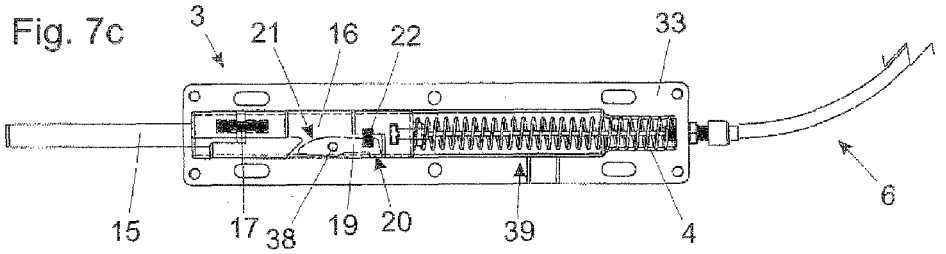
Figure 7D:
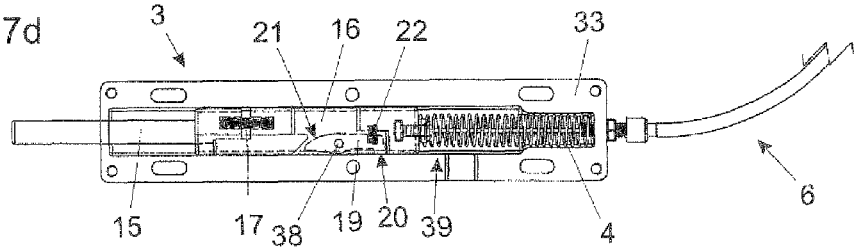
Figure 7E:
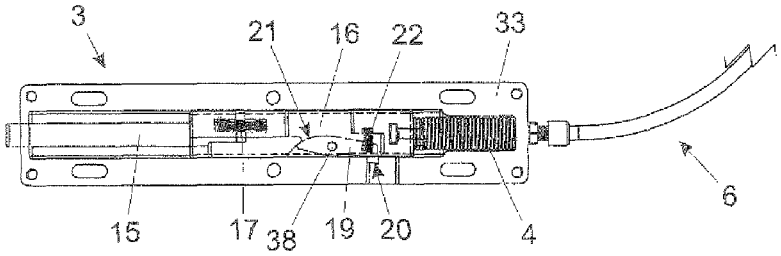

FIGS. 7*a* through 7*e* show a succession of diagrammatically illustrated cross-sectional views of the ejection device 3. In this respect, FIGS. 7*a* and 7*e* show that condition of the ejection device 3, in which the ejection element is locked. FIGS. 7*b* through 7*d* show those conditions of the ejection device 3, that it assumes in FIGS. 3 through 5.

Locking of the ejection element of the ejection device 3 is effected in that (see FIGS. 7*a* through 7*e*) the right-hand arm of the tilting lever 19 mounted rotatably about the axis of rotation 38 on the rear part 16 of the ejection element is pressed by the compression spring 22 with the latching projection 20 in positively locking relationship against a corresponding edge 39 on the housing 33 of the ejection device 3.

Unlocking is effected in that (see FIG. 7*b*) the front part 15 of the ejection element is moved towards the rear part 16 over the distance 14 in opposition to the direction of action of the compression spring 17 arranged between the two parts 15 and 16. Arranged on the front part 15 of the ejection element is an inclined surface (see also FIG. 1) which in the course of the unlocking movement bears against a corresponding inclined surface 21 arranged on the second arm of the tilting lever 19, which arm does not have the latching projection 20. As a result, the arm of the tilting lever 19 having the inclined surface 21 is moved downwardly, and the opposite arm is moved upwardly against the direction of action of the compression spring 22 (more specifically, until the latching projection 20 has moved beyond the edge 39 on the housing 33). The ejection element can now move unimpededly in the ejection direction under the energy which is liberated from the force storage element 4 (see FIG. 7*c*).

During the loading operation (see FIG. 7*a*), the ejection element is again pulled in the direction of its original position by the Bowden cable 6, more specifically until the arm of the tilting lever 19 having the latching projection 20 can move back into the locking position again under the action of the compression spring 22.

The invention claimed is:

1. An arrangement for moving a moveable furniture part, comprising:

at least one ejection device for ejecting the moveable furniture part from a closed position into an open position, wherein the at least one ejection device includes at least one force storage element configured to apply force against the moveable furniture part in a direction for moving the moveable furniture part toward the open position;

a loading device for loading the at least one force storage element by an opening or closing movement of the moveable furniture part; and at least one Bowden cable for transmitting force upon loading of the at least one force storage element, the at least one Bowden cable being arranged between the at least one ejection device and the loading device;

wherein the at least one force storage element includes at least one spring.

2. The arrangement as set forth in claim 1, wherein the at least one ejection device includes at least one moveable ejection element configured to be acted upon by the at least one force storage element.

3. The arrangement as set forth in claim 2, wherein a second end of the at least one Bowden cable is connected to the at least one ejection element.

4. The arrangement as set forth in claim 2, wherein each of the at least one ejection element of the at least one ejection device is linearly displaceable.

5. An article of furniture comprising:

a furniture carcass;

at least one furniture part mounted moveably in or on the furniture carcass; and at least one arrangement as set forth in claim 1 for moving the at least one furniture part.

6. The article of furniture as set forth in claim 5, wherein the at least one furniture part is mounted pivotably about an axis.

7. The article of furniture as set forth in claim 6, wherein the at least one furniture part is mounted pivotably about a horizontal axis.

8. The article of furniture as set forth in claim 1, wherein the at least one Bowden cable is configured to transmit force to the at least one force storage element from the loading device upon loading of the at least one force storage element without transmitting any force to the moveable furniture part.

9. An arrangement for moving a moveable furniture part, comprising:

at least one ejection device for ejecting the moveable furniture part from a closed position into an open position, wherein the at least one ejection device includes at least one force storage element configured to apply force against the moveable furniture part in a direction for moving the moveable furniture part toward the open position;

a loading device for loading the at least one force storage element by an opening or closing movement of the moveable furniture part; and at least one Bowden cable for transmitting force upon loading of the at least one force storage element, the at least one Bowden cable being arranged between the at least one ejection device and the loading device;

wherein the loading device includes at least one adjusting body and at least one adjusting contour, wherein the at least one adjusting body runs against the at least one adjusting contour at least during a part of the opening or closing movement.

10. The arrangement as set forth in claim 9, wherein the at least one adjusting contour has at least one neutral portion in which the at least one adjusting body and the at least one adjusting contour move relative to each other without loading the at least one force storage element.

11. The arrangement as set forth in claim 9, wherein the loading device has a rotatably mounted double-armed lever, wherein the at least one adjusting body is arranged on a first arm of the lever, and a second arm of the lever is operatively connected to a first end of the at least one Bowden cable.

12. The arrangement as set forth in claim 9, wherein the at least one adjusting body is formed as a rolling body or a sliding body.

13. The arrangement as set forth in claim 12, wherein the at least one adjusting body is formed as a pressure roller.

14. An arrangement for moving a moveable furniture part, comprising:

at least one ejection device for ejecting the moveable furniture part from a closed position into an open position, wherein the at least one ejection device includes at least one force storage element configured to apply force against the moveable furniture part in a direction for moving the moveable furniture part toward the open position;

a loading device for loading the at least one force storage element by an opening or closing movement of the moveable furniture part; and at least one Bowden cable for transmitting force upon loading of the at least one force storage element, the at least one Bowden cable being arranged between the at least one ejection device and the loading device;

wherein the at least one ejection device includes at least one moveable ejection element configured to be acted upon by the at least one force storage element; and wherein the at least one ejection element has at least two parts which are moveable relative to each other over a limited distance.

15. The arrangement as set forth in claim 14, wherein the at least one ejection element further includes at least one spring arranged between the two parts.

16. An arrangement for moving a moveable furniture part, comprising:

at least one ejection device for ejecting the moveable furniture part from a closed position into an open position, wherein the at least one ejection device includes at least one force storage element configured to apply force against the moveable furniture part in a direction for moving the moveable furniture part toward the open position;

a loading device for loading the at least one force storage element by an opening or closing movement of the moveable furniture part; and at least one Bowden cable for transmitting force upon loading of the at least one force storage element, the at least one Bowden cable being arranged between the at least one ejection device and the loading device;

wherein the at least one ejection device includes at least one moveable ejection element configured to be acted upon by the at least one force storage element; and wherein the at least one ejection device includes at least one locking device for releasably locking the at least one ejection element against action thereon by the at least one force storage element.

17. The arrangement as set forth in claim 16, wherein the at least one locking device is configured to be releasable by over-pressing in a direction opposite to the ejection direction.

18. The arrangement as set forth in claim 16, wherein the at least one locking device includes at least one tilting lever.

19. The arrangement as set forth in claim 18, wherein the at least one tilting lever is configured to embody at least one of the following:

has a latching projection, has an inclined surface, and/or is acted upon by at least one spring.

20. An arrangement for moving a moveable furniture part, comprising:

at least one ejection device for ejecting the moveable furniture part from a closed position into an open position, wherein the at least one ejection device includes at least one force storage element configured to apply force against the moveable furniture part in a direction for moving the moveable furniture part toward the open position;

a loading device for loading the at least one force storage element by an opening or closing movement of the moveable furniture part;

at least one Bowden cable for transmitting force upon loading of the at least one force storage element, the at least one Bowden cable being arranged between the at least one ejection device and the loading device; and at least one adjusting drive for applying force to the moveable furniture part, wherein the at least one adjusting drive is operatively connected to the loading device.

* * * * *